United States Patent [19]

Hilker et al.

[11] Patent Number: 4,794,884

[45] Date of Patent: Jan. 3, 1989

[54] INTERNAL COMBUSTION ENGINE WITH FLUID-COOLED CYLINDER LINER

[75] Inventors: Dieter Hilker, Cologne; Horst-Herbert Krause, Landwehr, both of Fed. Rep. of Germany

[73] Assignee: Kloeckner-Humboldt-Deutz AG, Fed. Rep. of Germany

[21] Appl. No.: 91,881

[22] Filed: Sep. 1, 1987

[30] Foreign Application Priority Data

Sep. 1, 1986 [DE] Fed. Rep. of Germany ..... 3629672

[51] Int. Cl.[4] ..... F02F 1/16

[52] U.S. Cl. ..... 123/41.79; 123/41.57; 123/41.72

[58] Field of Search ..... 123/41.42, 41.57, 41.72, 123/41.74, 41.79

[56] References Cited

U.S. PATENT DOCUMENTS

| | | | |
|---|---|---|---|
| 1,562,107 | 11/1925 | Madler | 123/41.79 |
| 1,926,684 | 9/1933 | Miller | 123/41.79 |
| 2,078,499 | 4/1937 | Ljungstrom | 123/41.42 |
| 2,162,082 | 6/1939 | Hazen | 123/41.79 X |
| 2,238,404 | 4/1941 | Spencer | 123/41.79 X |
| 2,411,924 | 12/1946 | Kratzer | 123/41.79 |

*Primary Examiner*—Tony M. Argenbright

*Attorney, Agent, or Firm*—Charles L. Schwab

[57] ABSTRACT

An internal combustion engine with a block cylinder head 7 and a fluid-cooled cylinder liner 1 has a cooling chamber between the cylinder liner 1 and the crankcase 2. The cooling chamber includes at least two partial cooling chambers *9a, 9b* which are connected only by a connecting channel 8, and wherein the first partial cooling chamber *9a*, which is adjacent to the cylinder head 7, is open in the direction of cylinder head 7 and passes over into a slot-shaped annular chamber 10 in cylinder head 7. A cooling arrangement for a cylinder liner for use with block cylinder heads is provided in which the cooling adjusts itself according to the quantities of heat which need to be removed, i.e., the thermal load is more uniformly carried over the entire axial length of the cylinder liners.

18 Claims, 5 Drawing Sheets

INTERNAL COMBUSTION ENGINE WITH FLUID-COOLED CYLINDER LINER

TECHNICAL FIELD

This invention relates to cooling an internal combustion engine and more particularly to liquid cooling of the cylinder liner of such an engine.

PRIOR ART STATEMENT

In West German patent No. DE-OS 29 45 249, an internal combustion engine with a removable cylinder liner is described which is inserted into a cylinder borehole in the engine block. The cylinder liner has a support band on its outer circumference approximately in the middle of its axial length by which the cylinder liner is supported on the crankcase. Above the support band, a cooling chamber is provided between the cylinder liner and the crankcase, which extends from the support band to a sealing area near the upper end of the cylinder liner, which end faces the cylinder head. The cylinder head is designed as a block cylinder head. Lubricating oil is used as the coolant.

The disadvantage in this arrangement lies in the fact that the cylinder liner is not cooled in proportion to its thermal load, since the very upper end of the cylinder liner which faces the cylinder head is not cooled, while the lower end which faces the crankcase is disproportionately heavily cooled up to the support band.

OBJECTS AND BRIEF SUMMARY OF THE INVENTION

It is an object of this invention to provide a replaceable cylinder liner and block cylinder head in which the cooling adjusts itself in accordance with the occurring quantities of heat to be removed, i.e., the thermal load is more evenly distributed over the total axial length of the cylinder liner.

The cooling chamber is made up of at least two partial cooling chambers which are connected only by means of connecting channels. The first partial cooling chamber is adjacent the cylinder head and is open at the cylinder head and passes over into a slot-shaped annular chamber in the cylinder head. By this construction the sought-after cooling of portions of the cylinder liner which are most highly stressed thermally can be achieved, and thus the thermal load over the total axial length of the cylinder liner is made more uniform. This sought-after cooling avoids over-cooling and allows for higher engine power. In addition, the transition area between the cylinder liner and the cylinder head, which is most highly stressed thermally, is cooled at a very high rate of heat transfer.

Preferably the cooling fluid inlet, which is designed as a distribution channel or manifold, passes through the entire cylinder series and is connected for purposes of supplying cooling fluid with the second partial cooling chamber for each cylinder liner. The second partial cooling chamber is the lower of the two partial cooling chambers and faces the crankcase. A cooling fluid outlet is connected to the first partial cooling chamber for each cylinder liner and the fluid outlet may be located within the cylinder head.

The cooling fluid outlet is preferably in the form of a collecting channel or manifold which is connected to the respective first partial cooling chambers of the entire series of cylinder liners of the engine.

Preferably, the respective first partial cooling chambers of two adjacent cylinder liners pass over into each other in the space between the adjacent cylinder liners.

In one of the embodiments of the invention, the cylinder liner is axially supported on the crankcase below the second partial cooling chamber and the first partial cooling chamber is axially separated from the second partial cooling chamber by a crankcase wall.

In this embodiment, it is preferred to provide a connecting passage or channel, for interconnecting the upper and lower partial cooling chambers, in the wall of the crankcase so as to extend axially along the cylinder liner. Appropriately, the cooling fluid inlet and the cooling fluid outlet are positioned relative to the cylinder liner in circumferentially spaced relation to the connecting channel.

In the preferred embodiment, the cooling fluid inlet and the cooling fluid outlet are arranged approximately at diametrically opposite sides of the cylinder liner. In another embodiment of the invention, the cylinder liner is supported between the first and second partial cooling chambers on a shoulder formed on a support wall of the crankcase. In such a construction it is preferable to connect the partial cooling chambers, which are adjacent to the crankcase support wall, to one another by means of a connecting channel formed in the support wall.

In addition to oils such as lubricating oil, water or other cooling fluids are suitable for use as the cooling fluid.

Other characteristics and advantages of the invention can be found in the accompanying description and drawings.

BRIEF DESCRIPTION OF THE DRAWINGS

Various embodiments of the invention are illustrated in the drawings, in which:

FIG. 2(*b*) is a vertical section through the axes of cylinder liners shown in FIG. 2(*a*);

FIG. 5(*b*) is a vertical section through the axis of the cylinder liners shown in FIG. 5(*a*).

DETAILED DESCRIPTION OF THE DRAWINGS

Figure 1:
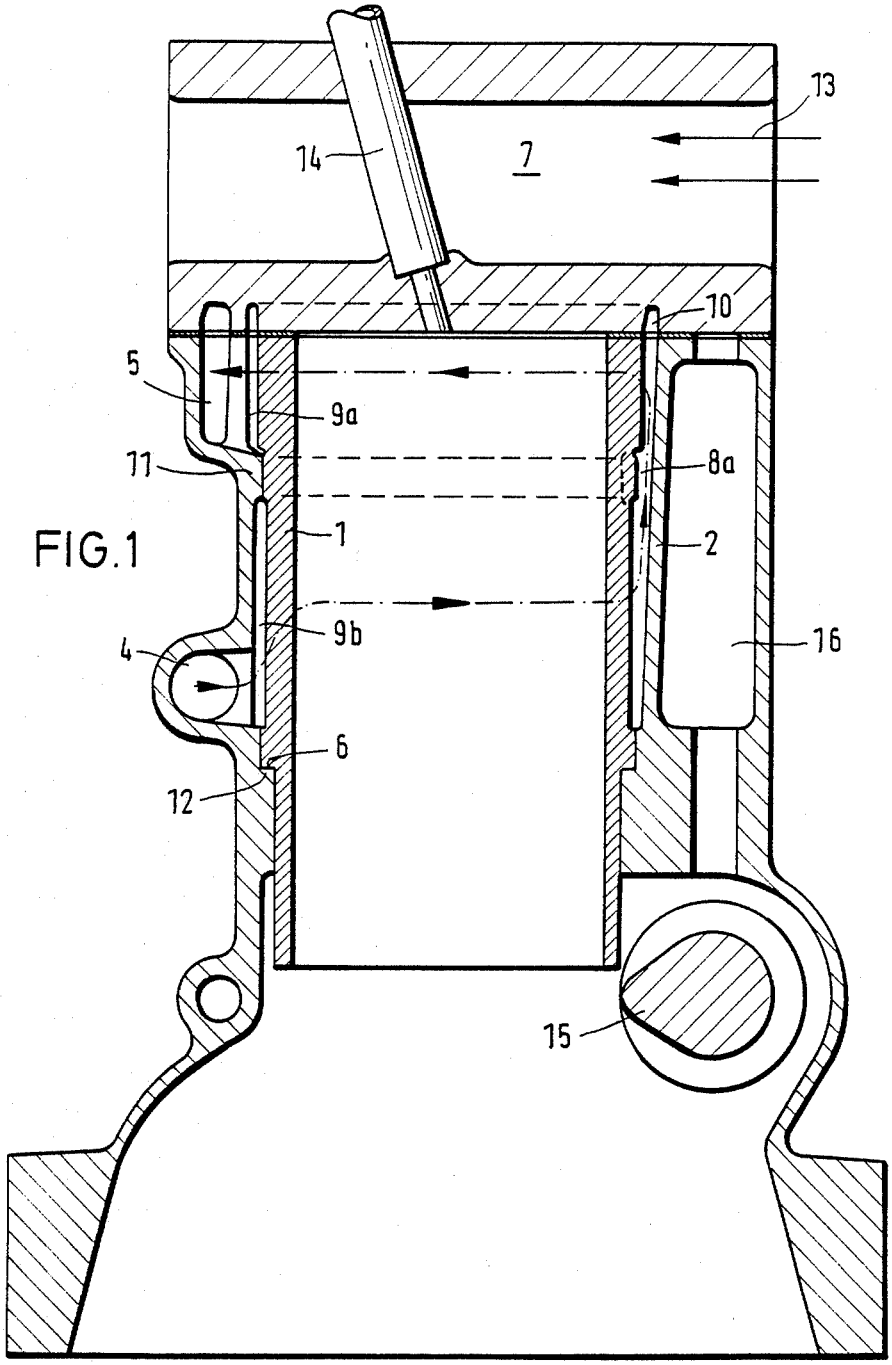
FIG. 1 is a cross-section through an internal combustion engine in which the cylinder liner is cooled by a divided cooling chamber and is supported on the crankcase below the cooling chamber, and in which the cylinder head is air-cooled.

FIG. 1 illustrates one embodiment of the invention in which an internal combustion engine has an air-cooled cylinder head 7 and each cylinder liner 1 is supported near its lower end. The cylinder liner 1 is of a stepped diameter construction with a downward facing annular surface or shoulder 12 near its lower end in axial abutment with an upward facing annular shoulder or support 6 formed on the crankcase 2. A cooling chamber is provided between the cylinder liner 1 and the crankcase 2, which is subdivided into two partial cooling chambers 9*a*, 9*b*.

A crankcase wall 11 which is in radial contact and fluid sealing relation with an outer circumferential surface of the cylinder liner 1 is part of the crankcase 2 and serves as a divider or partition for upper and lower partial cooling chambers 9*a*, 9*b*. A single fluid-conducting connection between partial cooling chambers 9*a*, 9*b* is formed by a connecting chamber 8*a*, which is a radially inward open recess in the crankcase wall 11 and extends vertically through the latter in an axial direction relative to the cylinder liner 1. The lower-most or second partial cooling chamber 9*b*, which faces the crankcase 2, is provided with a coolant inlet 4 at its lower end, which is advantageously designed as a distribution channel or manifold and connects to all of the second partial cooling chambers of the series of cylinder liners in the engine.

The part of the upper-most or first partial cooling chamber 9*a*, which is disposed radially between the cylinder liner and crankcase 2, is open at its upper end and is in free flow fluid communication with an annular recess or chamber part 10 in the block cylinder head 7. A cooling fluid outlet 5 opens into this partial cooling chamber 9*a* along one longitudinal side of the series of in-line cylinder liners, whereby it forms a collecting channel or manifold which is connected to all the cylinder liners of the engine.

The illustrated cylinder head 7 is air-cooled, with the arrows 13 representing the possible air flow directions, and has, in addition to an injection nozzle 14, all of the components necessary for an internal combustion engine such as air intake and exhaust passages, valves, valve rockers, etc.

A cam shaft 15 drives a tappet 16, which functions together with a valve rocker, not shown, in the cylinder head 7 to activate a valve.

The cooling fluid, which may be lubricating oil or even water, enters the second partial cooling chamber 9*b* through the cooling fluid inlet 4, flows circumferentially around the cylinder liner 1 and then flows up through the connecting channel 8*a*, which connects the partial cooling chambers 9*a*, 9*b* with each other. The connecting channel 8*a* is circumferentially positioned diametrically opposite the coolant inlet 4 and the cooling outlet 5. The cooling fluid enters the first partial cooling chamber 9*a* through the connecting channel 8*a* and flows circumferentially about the cylinder liner 1 opposite to the circumferential flow in the second partial cooling chamber 9*b*. The cooling fluid is discharged from the first partial cooling chamber 9*a* by way of the coolant outlet 5.

Figure 2:
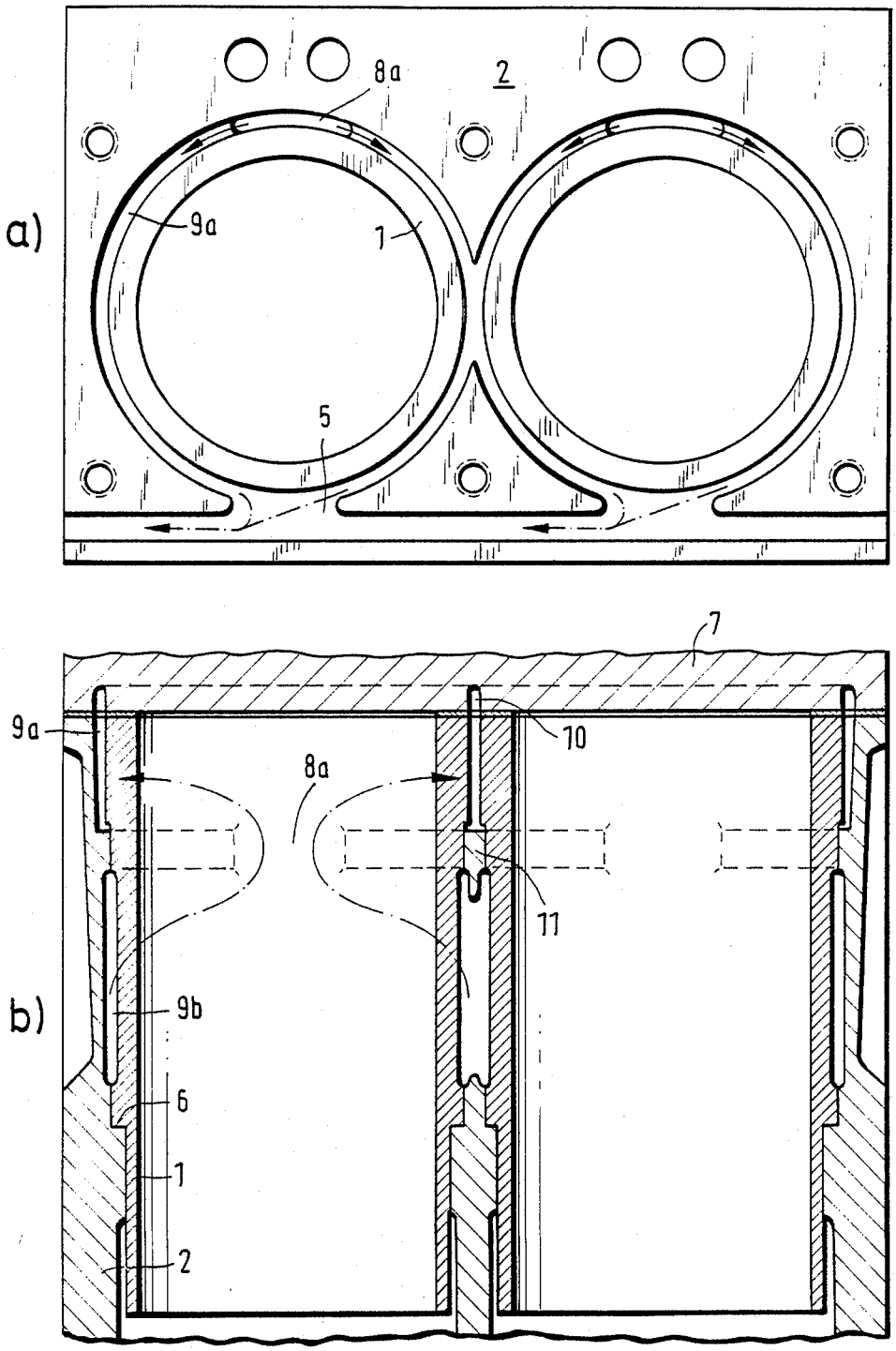
FIG. 2(*a*) is a top view of the engine of FIG. 1 with the cylinder head removed.

FIGS. 2(*a*) and 2(*b*) are different views of the engine shown in FIG. 1. FIG. 2(*a*) is a top view in which it can be clearly seen that the various first partial cooling chambers 9*a* of two adjacent cylinders pass over into each other in the space between the adjacent cylinders. Because of this, intensive cooling of precisely these points, which are highly stressed thermically, is achieved. It is also desirable to allow the partial cooling chambers 9*b* of two adjacent cylinders to pass over into each other, in order to achieve the greatest possible cooling in the lower part of the cylinder liner 1. Coolant outlet 5 is, as has already been described, designed as a collecting channel and extends to the entire cylinder series.

FIG. 2(*b*) is a vertical section through the axes of the cylinders which shows the arrangement of partial cooling chambers 9*a*, 9*b* and the connecting channel 8*a*. The second partial cooling chamber 9*b* is provided between the crankcase wall 11 and the supporting shoulder 6, and is connected to the first partial cooling chamber 9*a* via the connecting channel 8*a*. The first partial cooling chambers 9*a* of two adjacent cylinders pass over into each other in the space between the adjacent cylinders.

Figure 3:
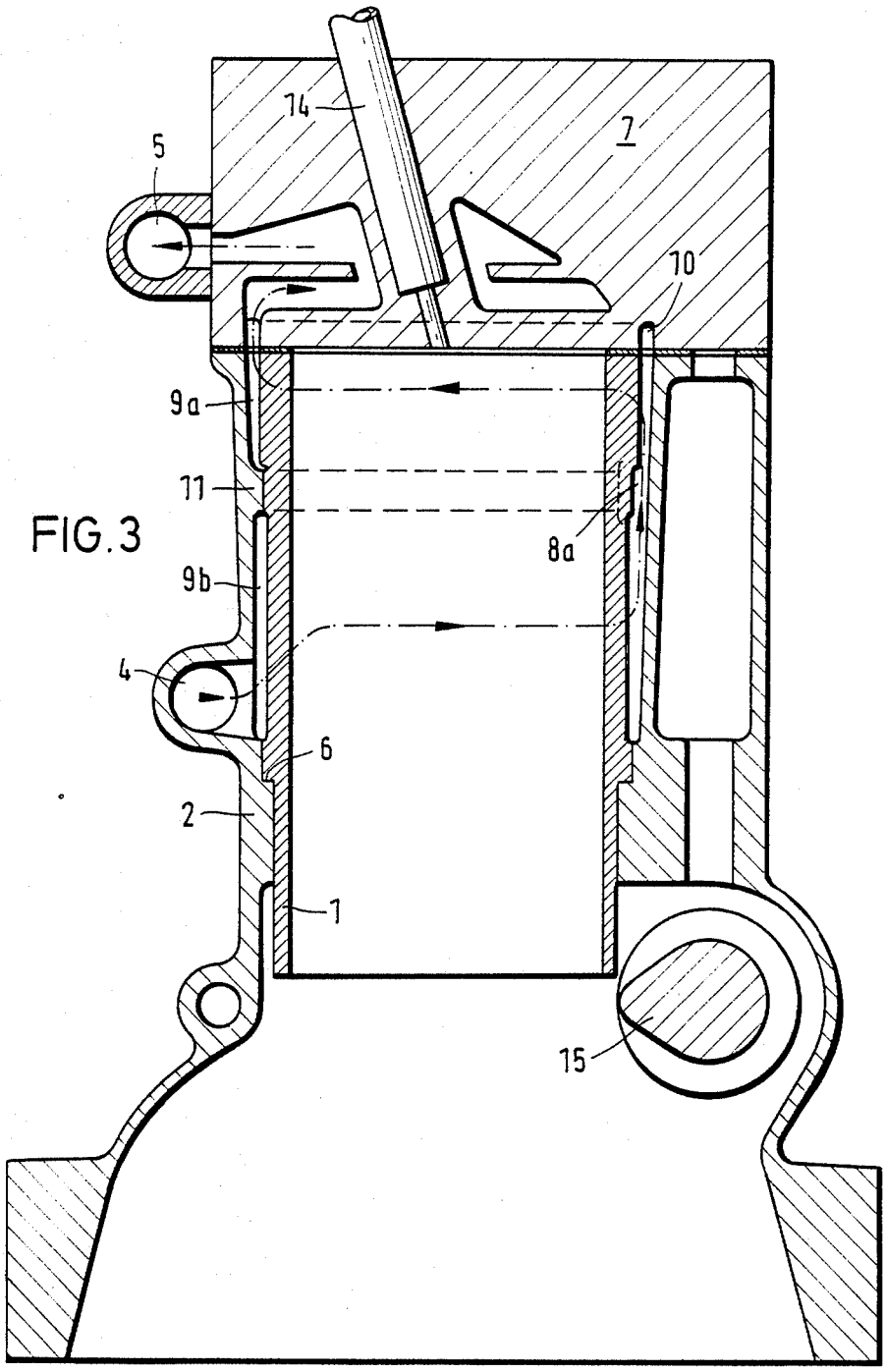
FIG. 3 is a vertical cross-section through an engine incorporating a second embodiment of the invention in which the cylinder head is oil-cooled and the cooling fluid outlet is placed in the cylinder head.

FIG. 3 shows an embodiment of the invention in an engine having an oil-cooled cylinder head and with the cooling fluid outlet 5 formed in the cylinder head 7. A cooling passage leads from the annular chamber part 10 of the first partial cooling chamber 9*a* through the cylinder head 7, where it cools, among other things, the injection nozzle 14, and thence flows to the cooling fluid outlet 5, which also is designed, as in the FIG. 1 embodiment, as a collecting channel.

Figure 4:
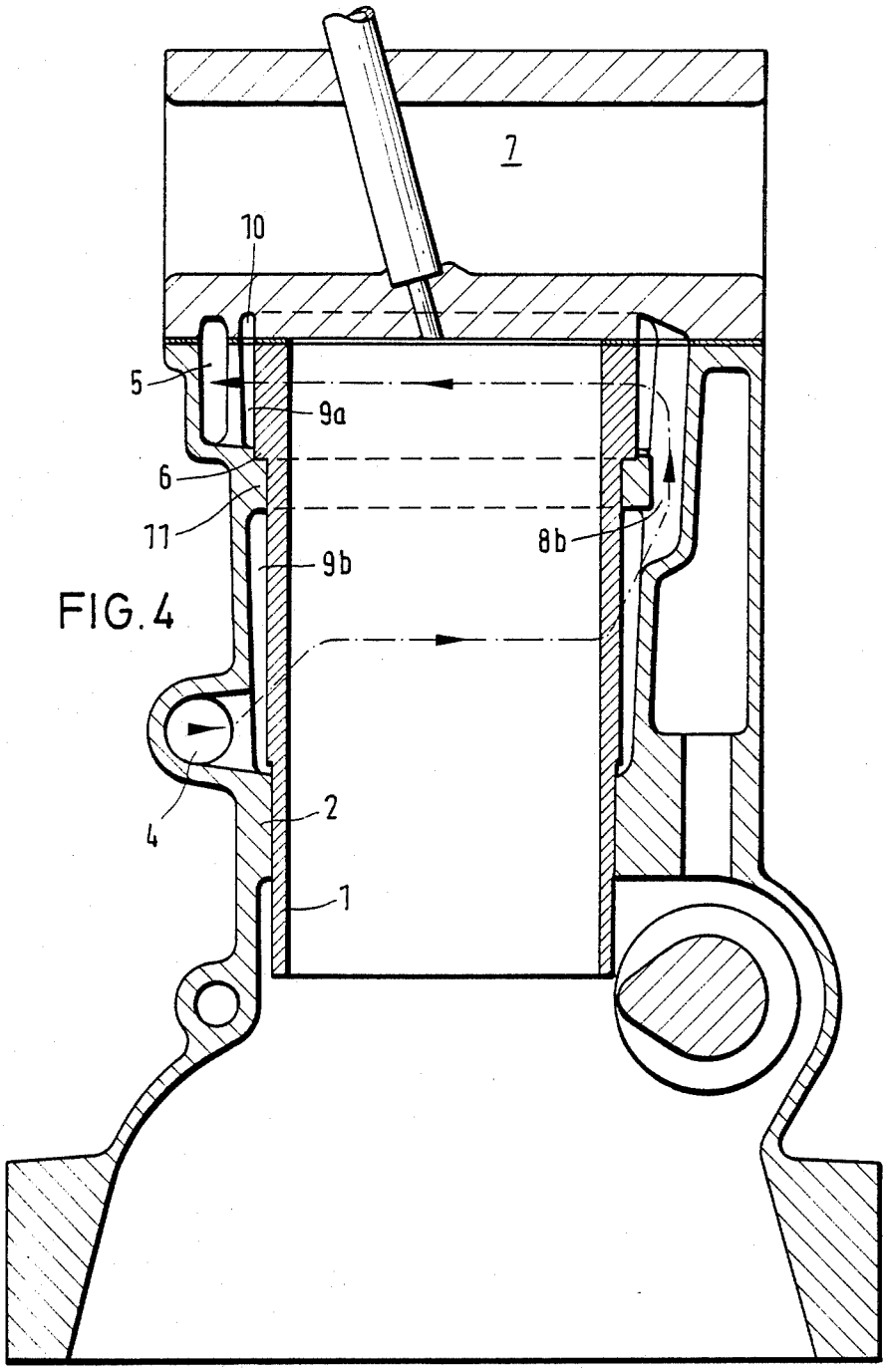
FIG. 4 is a vertical cross-section through an engine incorporating a third embodiment of the invention in which the cylinder liner is supported on a crankcase wall intermediate the upper and lower cooling chambers surrounding the cylinder liner.
Figure 5:
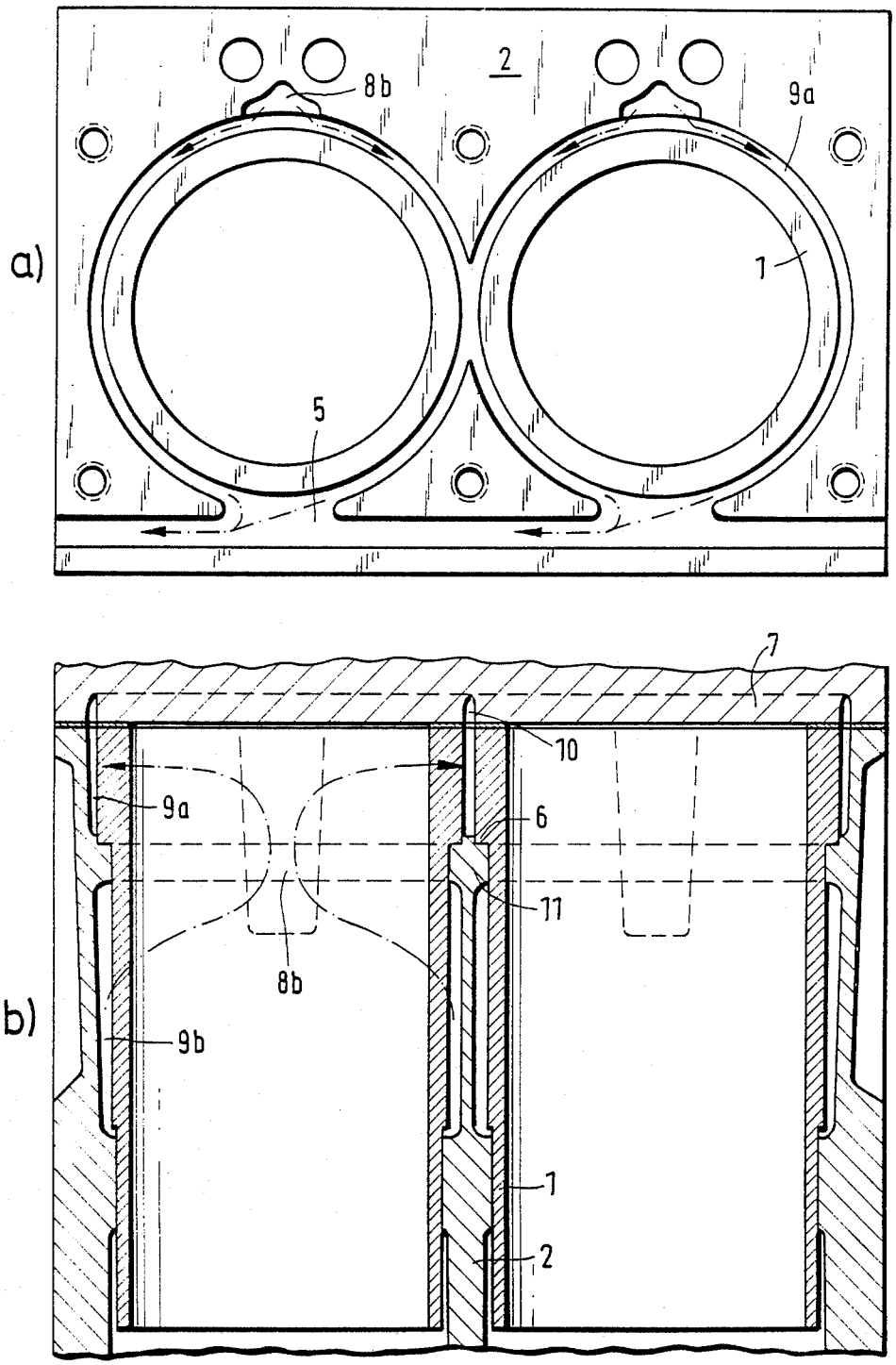
FIG. 5(*a*) is a top view of the engine of FIG. 4 with the cylinder head removed.

FIGS. 4, 5(*a*) and 5(*b*) show a third embodiment of the invention in which the cylinder liner 1 is supported on the crankcase wall 11 which, as has already been described, separates partial cooling chambers 9*a* and 9*b* from each other. Because the crankcase wall 11 also serves as a support, the partial cooling chambers 9*a*, 9*b* which are adjacent to the support wall 11 are connected with each other via a connecting channel 8*b* conveniently formed in the crankcase 2. The connecting channel 8*b* extends through—in the axial direction of the cylinder liner 1—the entire first cooling chamber 9*a*. In order that the crankcase wall 11 can support the cylinder liner 1 about its full circumference, the crankcase wall 11 completely encircles the cylinder liner 1 in an unbroken manner. In the embodiment of FIGS. 4, 5(*a*) and 5(*b*) the second partial cooling chambers 9*b* of adjacent cylinder liners do not cross over into each other in the space between the adjacent cylinder liners.

The embodiments of the invention in which an exclusive property or privilege is claimed are defined as follows:

1. An internal combustion engine having a series of cylinders, a crankcase (2), a block cylinder head (7), a fluid-cooled cylinder liner (1) for each cylinder having an upper end facing the cylinder head (7), a cooling chamber between each cylinder liner (1) and the crankcase (2), to which coolant is delivered via an inlet (4) and discharged via an outlet (5) during operation of the internal combustion engine, each said cylinder liner (1) having a collar presenting a support surface supported on a shoulder (6) formed on the crankcase (2), characterized by said cooling chamber associated with each said cylinder liner including first upper partial cooling chamber (9*a*) and a second lower partial cooling chamber (9*b*), said partial chambers being interconnected solely by a vertically extending connecting channel, said first partial cooling chamber (9*a*) being open adjacent said cylinder head (7) and extending into a slot-shaped annular chamber (10) formed in the cylinder head (7).

2. The internal combustion engine of claim 1, wherein said inlet (4) is a collecting channel passing through the entire cylinder series and is connected so as to convey cooling fluid to the second partial cooling chamber (9*b*) which is adjacent to the crankcase (2).

3. The internal combustion engine of claim 2, wherein said outlet (5) is connected to said first partial cooling chambers (9*a*).

4. The internal combustion engine of claim 3, wherein said outlet (5) is formed in said cylinder head (7).

5. The internal combustion engine of claim 4, wherein said outlet (5) is a collecting channel passing through the entire cylinder series.

6. The internal combustion engine of claim 5, wherein said first partial cooling chambers (9*a*) of two adjacent cylinders pass over into each other in the interspace between said adjacent cylinders.

7. The internal combustion engine of claim 6, wherein said crankcase presents a wall (11) axially separating said first and second partial cooling chambers (9*a*) and (9*b*) and wherein said cylinder liner (1) is supported on a shoulder formed on said crankcase (2).

8. The internal combustion engine of claim 7, wherein said connecting channel is formed in said crankcase wall (11).

9. The internal combustion engine of claim 8, wherein said outlet (5) and said connecting channel are circumferentially spaced in relation to said cylinder liner (1).

10. The internal combustion engine of claim 9, wherein the said inlet (4) and said outlet (5) are circumferentially positioned relative to the cylinder liner (1) diametrically opposite to said connecting channel.

11. The internal combustion engine of claim 10, wherein said cylinder liner (1) is supported on said crankcase wall (11) disposed between said first partial cooling chamber (9*a*) and said second partial cooling chamber (9*b*).

12. The internal combustion engine of claim 11, wherein said partial cooling chambers (9*a*, 9*b*) are connected to each other via a connecting channel (8*b*) formed in said crankcase wall (11).

13. The internal combustion engine of claim 12, wherein said coolant is water.

14. The internal combustion engine of claim 1 wherein said shoulder (6) is on said crankcase wall (11).

15. The internal combustion engine of claim 14 wherein said connecting channel is formed in said crankcase without interrupting the annular continuity of said shoulder (6).

16. The internal combustion engine of claim 1 wherein said support surface and collar are below said second cooling chamber.

17. The internal combustion engine of claim 1 wherein said crankcase wall (11) separates said first and second partial cooling chambers.

18. The internal combustion engine of claim 17 wherein said connecting channel is formed in said crankcase wall (11).

* * * * *